US006243874B1

(12) United States Patent
Yoon

(10) Patent No.: US 6,243,874 B1
(45) Date of Patent: Jun. 12, 2001

(54) FOLDABLE NECKTIE

(76) Inventor: Jong Oh Yoon, 256-3 Shinyangbok-ri Keumkwang-myun, Ansung-shi, Kyungki-do (KR)

( * ) Notice: Subject to any disclaimer, the term of this patent is extended or adjusted under 35 U.S.C. 154(b) by 0 days.

(21) Appl. No.: 09/598,065

(22) Filed: Jun. 20, 2000

(30) Foreign Application Priority Data

Jul. 2, 1999 (KR) ..... 99-12909
Oct. 18, 1999 (KR) ..... 99-22397

(51) Int. Cl.[7] ..... A41D 25/00
(52) U.S. Cl. ..... 2/144; 2/146
(58) Field of Search ..... 2/144, 146, 147, 2/149, 150, 152.1, 153, 157, 155, 156

(56) References Cited

U.S. PATENT DOCUMENTS 1,897,734 * 2/1933 Rossner ..... 2/144
2,103,094 * 12/1937 Scharlin ..... 2/144
2,860,346 * 11/1958 Siebler et al. ..... 2/144
3,487,471 * 1/1970 Hagen ..... 2/144
3,500,476 * 3/1970 Nuttall ..... 2/144

* cited by examiner

*Primary Examiner*—Gloria M. Hale
(74) *Attorney, Agent, or Firm*—Eric Bleich; Marguerite DelValle

(57) ABSTRACT

A necktie having a series of interconnecting fasteners at its wide end and along its middle section, proximate to the wide end. The two cooperating fasteners at the wide end allow a wearer to fold this end of the tie up on itself, for a small hanging length reduction, relative to the length of the entire tie. The wearer may further shorten the hanging length by folding the wide end up to the middle section, where a third fastener connects to those of the wide end to secure the necktie in a folded formation that restricts it from interfering with the wearer's movement.

8 Claims, 8 Drawing Sheets

FOLDABLE NECKTIE

BACKGROUND OF THE INVENTION

1. Field of the Invention

This invention relates to a foldable necktie, particularly to a necktie of which the one side comprises a folding means, whereby the end part of a necktie is transformed to present new sense of beauty or the necktie dangled is folded in short when a wearer washes his hands or playes a simple sport to make the action simplier and easier.

2. Description of the Prior Art

Generally, the end part of a necktie is formed with two obliques of an inverse triangle and hangs down to the wearer's waist in wearing, which is a conventional shape and using state.

However, the above conventional necktie has problems that it can not change the form and the shape or control the length thereof in wearing.

In addition, the above necktie has some problems that when a wearer washes his hands or works and is bending, the necktie is caught by his hand, the end part of the necktie touches on a washstand or water splashes on it and makes spots so that the wearer feels inconvenient.

Also in playing the sports such as the billiards, a wearer bends at his waist, at this time, the necktie hangs down and is in contact with a billiard table or a billiard ball so that the wearer folds the necktie putting it into his shirt.

SUMMARY OF THE INVENTION

This invention is designed to solve the problems as above stated, the object of the invention is to provide a necktie of which the one side comprises the fasteners attached at the upper and the lower portion respectively, wherein the necktie can be folded to be fixed, whereby the necktie end part can be transformed for various shapes; or the necktie length can be shortened to make the action easier in working actively.

BRIEF DESCRIPTIONS OF THE DRAWINGS

FIG. 1*a* is a perspective view showing the state of the end part folded according to the present invention.

FIG. 1*b* is a perspective view showing the state of the shortened length of the necktie according to the present invention.

FIG. 2*a* is a front view showing the state of the end part folded according to the present invention.

FIG. 2*b* is a front view showing the state of the shorten length of the necktie according to the present invention.

FIG. 3*a* is a side view showing the state of the end part folded according to the present invention.

FIG. 3*b* is a side view showing the state of the shortened length of the necktie according to the present invention.

FIG. 4*a* is a rear view showing one embodiment of the fastener composed of a button and two buttonholes according to the present invention.

FIG. 4*b* is a rear view showing another embodiment of the fastener composed of a button and two buttonholes according to the present invention.

FIG. 5 is a front view showing the state of the button projected frontward according to the present invention.

FIG. 6*a* is a side view showing the state of the button and the loop attached to the bilateral sides of the necktie.

FIG. 6*b* is a side view showing the used state of FIG. 6*a*.

DESCRIPTION OF THE PREFERRED EMBODIMENT

Figure 1A:
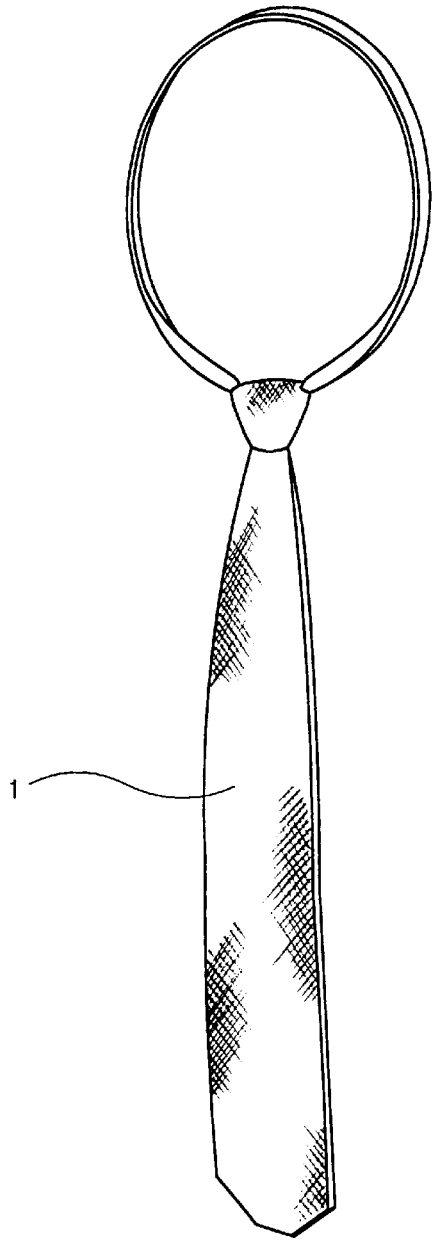

Referring now to the drawings, the embodiments according to this invention are described in detail.

Figure 1B:
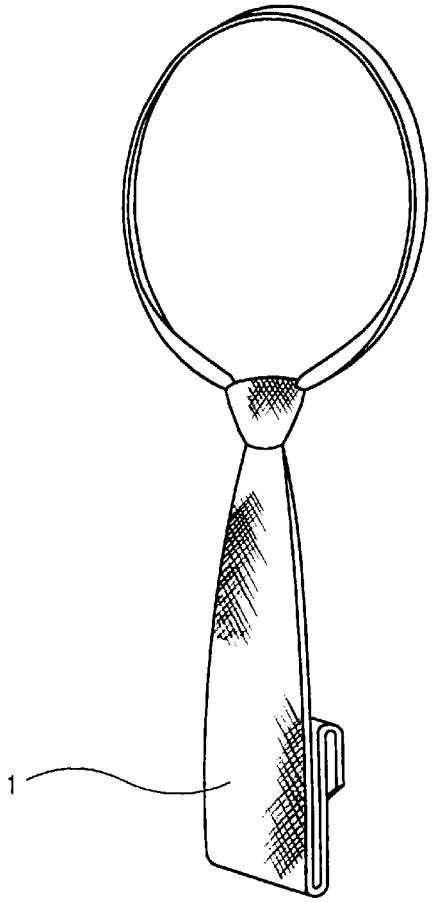
Figure 2A:
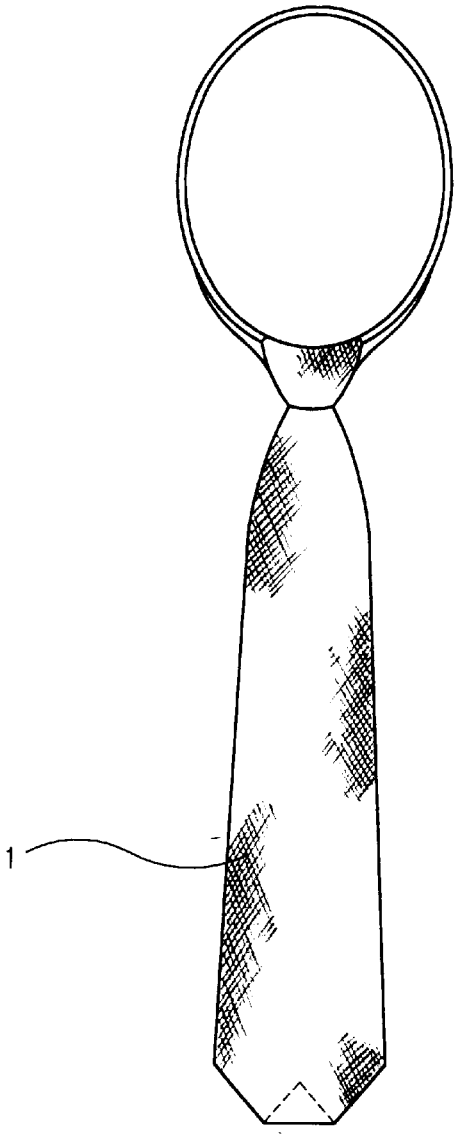
Figure 2B:
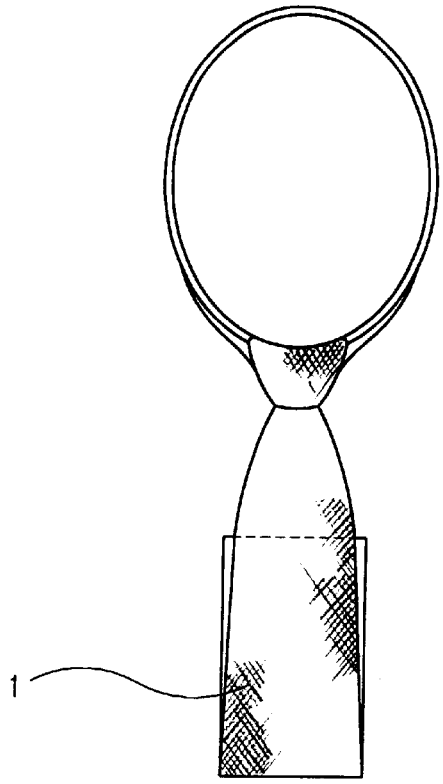
Figure 3A:
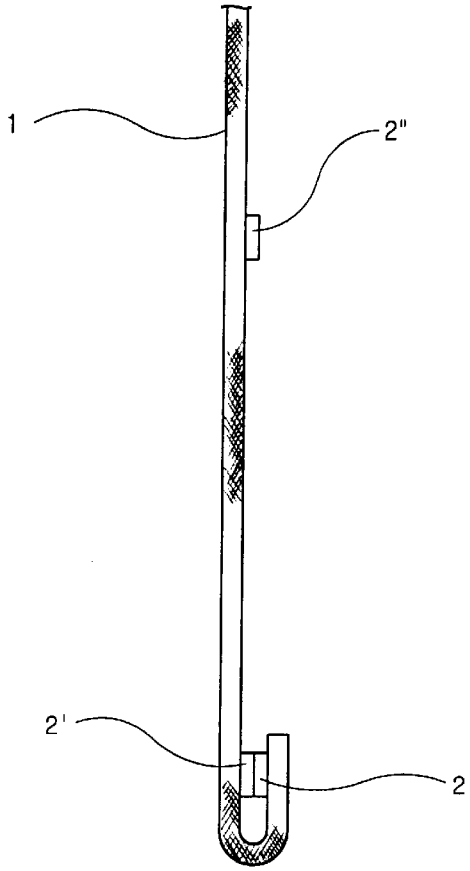
Figure 3B:
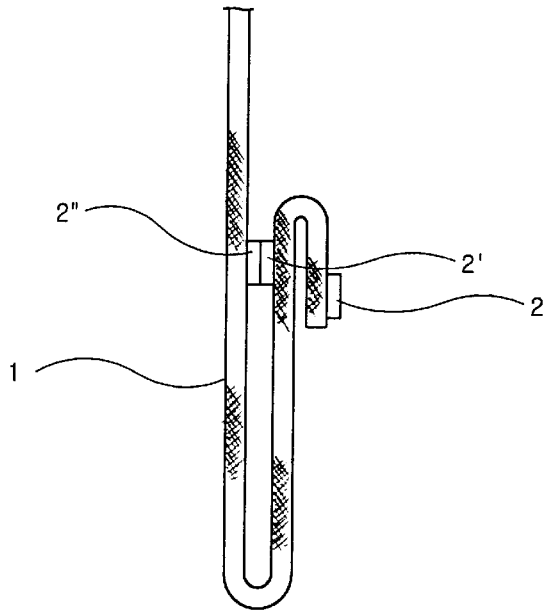

FIG. 1 is a whole perspective view showing the state of the necktie folded from the front according to the present invention, FIG. 1*a* is showing the state that only the end part is folded, FIG. 1*b* is in the state folded at the half thereof, FIG. 2*a* and FIG. 2*b* are views explaining the sectional front views thereof. FIG. 3*a* and FIG. 3*b* are side views thereof.

In a general necktie 1, the fasteners 2, 2' and 2" are installed separately at the one side thereof and the folding means comprises a fastener 2 formed at the lower portion and at least the fastener 2', 2" formed separately at the upper portion, by connecting the fasteners 2, 2' and 2", the folding is possible.

Besides, as embodiments of the fasteners 2, 2' and 2", buttons and buttonholes, buttons and loops with a sliding stopper 3, snaps, hook and loop fasteners, hooks and the like can be selected according to the use and the shape.

Hereinafter, the operation of the present invention will be described in more detail referring to the attached drawings.

As shown in the explanatory front views of FIG. 1*a*, 1*b* or FIG. 2*a*, 2*b*, and the explanatory side views of FIG. 3*a*, 3*b*, if the fastener 2 positioned at the lower portion of the one side is fixed to the opposite fastener 2' formed just above thereof, the end part of the necktie can be kept in the state folded for changing the shape so that the necktie can be transformed, if the fastener 2 is fixed to the upper opposite fastener 2", the action obstacle due to the necktie can be reduced.

Figure 4A:
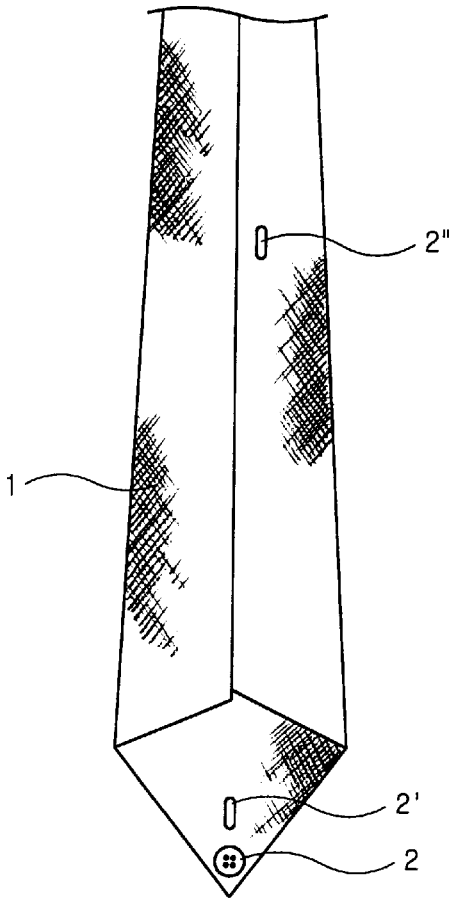
Figure 4B:
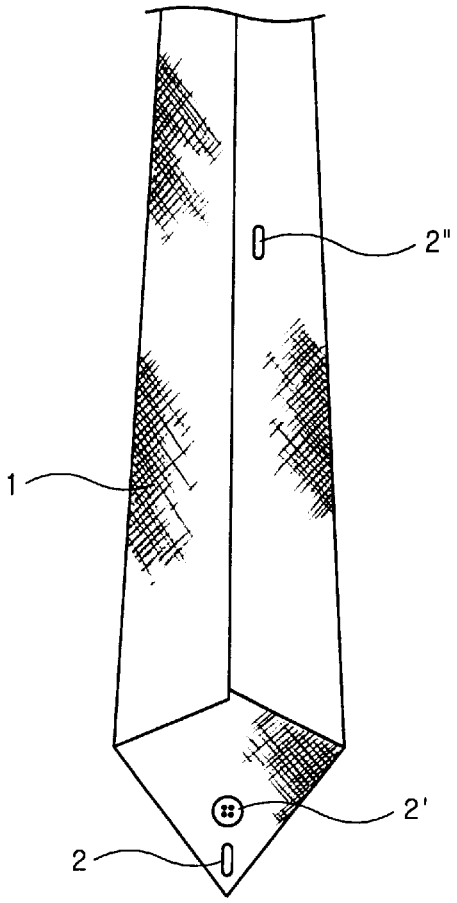

FIG. 4*a* and FIG. 4*b* are showing the fasteners 2, 2' and 2" composed of buttons and buttonholes, as shown in FIG. 4*a*, the button in the lower portion is inserted into the upper buttonhole to change the shape of the end part or into the top buttonhole to make the necktie length short thereby increasing the wearer's ability to be more active, or the buttonhole can be used directly with the button of a shirt(not shown in drawings).

As shown in FIG. 4*b*, into the lower buttonhole is inserted the button positioned just above to make the end part folded, or into the highest buttonholes to make the necktie length short.

Figure 5:
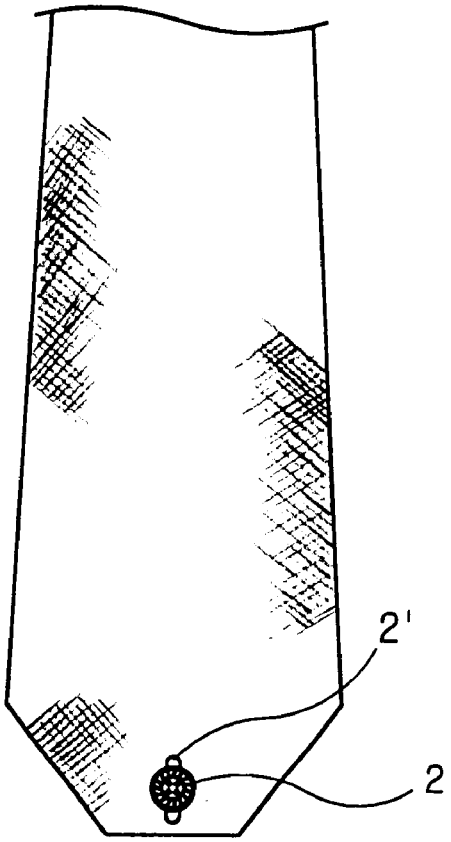

In the change of the necktie by buttons and buttonholes as shown in FIG. 5, the button in connecting is projected to the front of the necktie so that the necktie can have also the decorating effect by the design of the button.

Figure 6A:
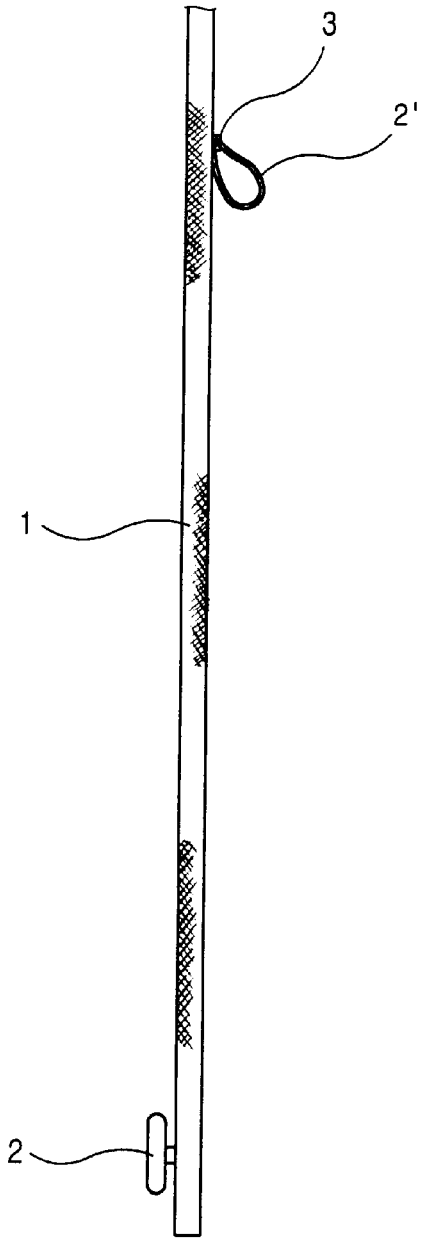
Figure 6B:
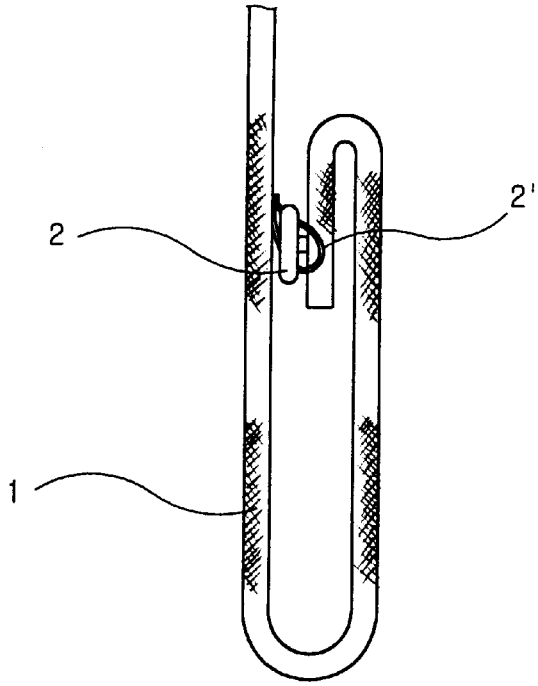

In FIG. 6*a* and FIG. 6*b*, as the button and the loop with the sliding stopper 3 are attached at the bilateral sides of the necktie, the drawings show the state that the button is attached to the lower portion of one side and the loop to the upper portion of another side.

The button and the loop attached as above are connected each other by folding the end part of the necktie to insert the button into the loop of the another side as shown in FIG. 6*b*.

Figure 7:
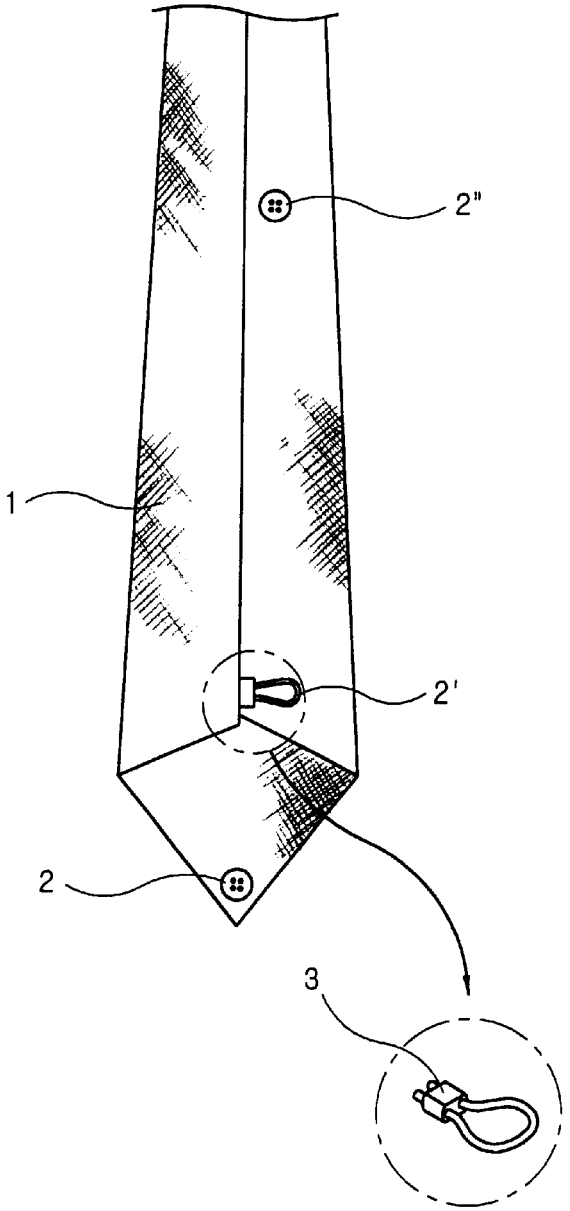
FIG. 7 is a rear view showing the state of the button and the loop connected to the one side of the necktie.

In addition, as shown in FIG. 7, the fasteners 2, 2' and 2" are composed of two buttons and a loop, wherein a button is positioned at the lowest portion; the loop is formed above thereof; and then another button is attached at the upper portion, whereby the button of the lowest portion is inserted into the loop above thereof to make the end part of the necktie folded or into the loop is inserted the button of the upper portion to make the necktie short.

Also, the loop is connected to the button of a shirt (not shown in drawings) as the above buttonhole so that the necktie can be used to be folded variously according to the convenience of an wearer.

Such a loop is fixed harder to the button by moving the conventional sliding stopper 3 in the state that the loop with a sliding stopper 3 is connected to the button, whereby the loop is not detached from the button.

Figure 8:
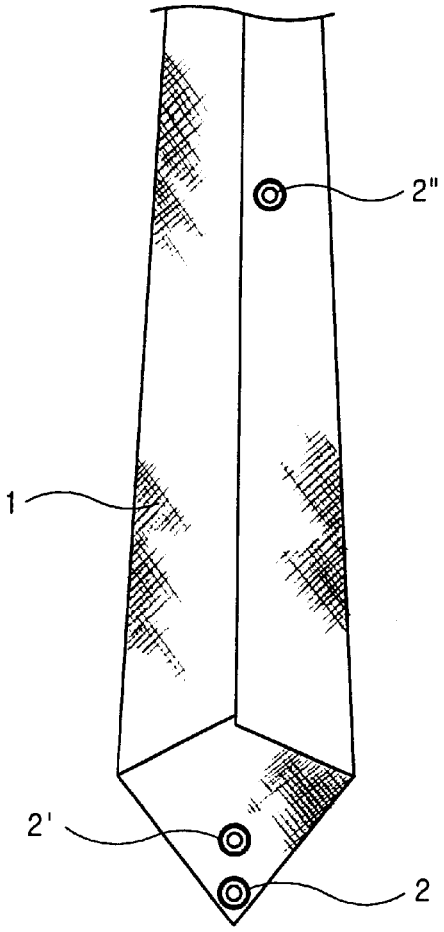
FIG. 8 is a rear view showing the state of the snaps connected to the one side of the necktie.

FIG. 8 shows the fasteners 2, 2' and 2" composed of the snaps, the snaps attached to the lower portion and the upper portion are the same and the snap button attached to the middle portion is the opposite thereof, whereby the lower conjunction snap is connected to the middle snap to change the end part of the necktie or the middle snap is connected to the upper snap to reduce the necktie length.

Figure 9:
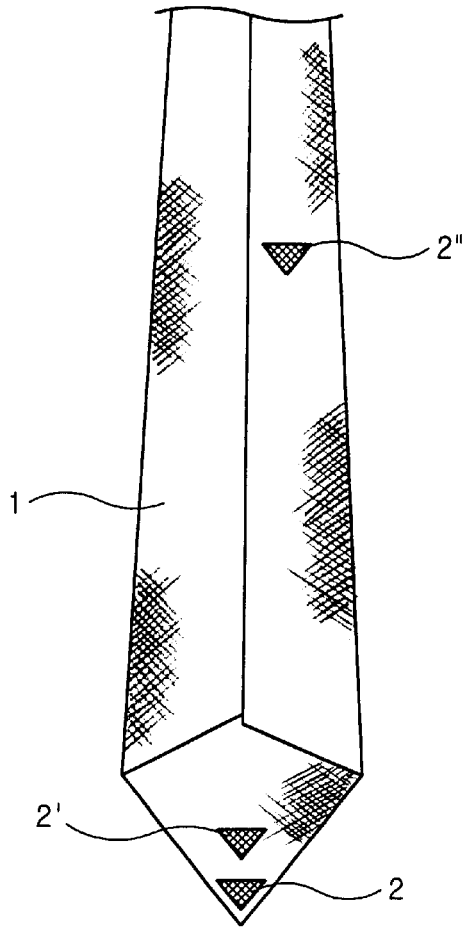
FIG. 9 is a front view showing the fastener composed of hook and loop fasteners according to the present invention.

Also, as shown in FIG. 9, as the fasteners 2, 2' and 2" comprise hook and loop fasteners, VELCRO®. If one of the hook and loop fasteners on the wide end of the necktie is attached to the closest hook and loop fastener on the wide end, the wide end part is transformed, and if one of the hook and loop fasteners on the wide end also is attached to the hook and loop fastener on the middle section of the tie, the length of the necktie is reduced.

Figure 10:
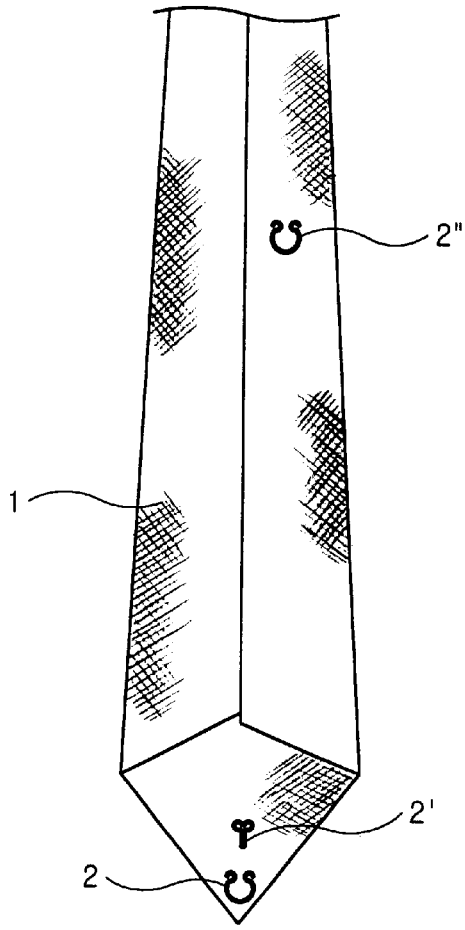
FIG. 10 is a front view showing the fastener composed of interlocking hooks.

As shown in FIG. 10, also in case the fasteners 2, 2' and 2" are hooks, the hook formed at the lower portion is hung onto the opposite hook positioned at the upside to transform the end part of the necktie, or the middle hook is inserted into the another opposite hook formed at the upper portion to reduce the necktie length.

Thus, the necktie folded as above can be used as a necktie with new sense of beauty by transforming the end part. Also by shortening the necktie length, the user does not feel burdensome when he washes his hands or enjoys recreation such as a billiard and the like, and the necktie will not be an obstacle hanging down. The folding method is simple and easy so that the necktie can be folded quickly, to the contrary, also in case the original shape of the necktie is returned, by separating only the fasteners 2, 2' and 2" the original shape can be returned so that the use method is very convenient.

Accordingly, a wearer can use the necktie in a polished and elegant style more than before by changing the necktie length.

The foldable necktie shape of this invention according to the above operation, can be varied by transforming the necktie end part or can make the action easy by the shortened necktie when a wearer works and plays actively.

What is claimed is:

1. A foldable necktie comprising:

a necktie having wide and narrow ends and a middle section, said middle section interposed between said wide and narrow ends, first and second fasteners formed on said wide end and a third fastener formed on said middle section, proximate to said wide end, said first, second and third fasteners being interconnectable upon folding said necktie to secure said necktie in folded formations.

2. The foldable necktie of claim 1, said fasteners comprising buttons and buttonholes.

3. The foldable necktie of claim 1, said fasteners comprising buttons and loops.

4. The foldable necktie of claim 1, said fasteners comprising buttons and loops, said buttons formed on a front surface of said wide end and said loops formed on a back surface of said necktie.

5. The foldable necktie of claim 1, said loop fasteners each further comprising a sliding stopper, said stopper insertably receiving said loop fastener.

6. The foldable necktie of claim 1, said fasteners comprising snaps.

7. The foldable necktie of claim 1, said fasteners comprising fabric hook and loop fasteners.

8. The foldable necktie of claim 1, said fasteners comprising interlocking hooks.

* * * * *